US011041425B1

(12) United States Patent
Yano

(10) Patent No.: US 11,041,425 B1
(45) Date of Patent: Jun. 22, 2021

(54) AIR-COOLED ENGINE

(71) Applicant: Kawasaki Jukogyo Kabushiki Kaisha, Kobe (JP)

(72) Inventor: Takahiro Yano, Kakogawa (JP)

(73) Assignee: KAWASAKI JUKOGYO KABUSHIKI KAISHA

( * ) Notice: Subject to any disclaimer, the term of this patent is extended or adjusted under 35 U.S.C. 154(b) by 0 days.

(21) Appl. No.: 17/013,755

(22) Filed: Sep. 7, 2020

(51) Int. Cl.
*F01P 5/06* (2006.01)
*F01P 11/12* (2006.01)
*F02P 5/02* (2006.01)

(52) U.S. Cl.
CPC ..... *F01P 5/06* (2013.01); *F01P 11/12* (2013.01)

(58) Field of Classification Search
CPC ... B60K 11/06; F01P 11/12; F01P 1/00; F01P 5/02; F01P 5/06; F01P 9/00; F02F 7/007
See application file for complete search history.

(56) References Cited

U.S. PATENT DOCUMENTS 2,968,360 A * 1/1961 Goldsmith ..... E03B 3/28 96/136
5,630,385 A * 5/1997 Taomo ..... F01L 13/08 123/182.1
6,145,479 A * 11/2000 Rotter ..... F01P 3/18 123/41.11
7,721,708 B2 5/2010 Matsuda et al.
2002/0187045 A1* 12/2002 Ijima ..... F04D 29/2227 416/223 A
2003/0138323 A1* 7/2003 Lacey ..... F04D 29/2222 416/182
2003/0208997 A1* 11/2003 Bayer ..... B01D 50/002 55/320
2008/0184682 A1* 8/2008 Nelson ..... B01D 46/10 55/385.3
2009/0293821 A1* 12/2009 Nakamizo ..... F01P 5/06 123/41.65
2009/0293835 A1* 12/2009 Nakamizo ..... F02M 35/08 123/198 E
2018/0223722 A1* 8/2018 Bykowski ..... F01P 11/10
2018/0231241 A1* 8/2018 Hung ..... F04D 29/703

* cited by examiner

*Primary Examiner* — Long T Tran
(74) *Attorney, Agent, or Firm* — Snell & Wilmer LLP

(57) ABSTRACT

An air-cooled engine includes: a cooling fan configured to rotate in conjunction with an engine rotation shaft; a fan housing covering the cooling fan; a screen having a disk shape and configured to rotate integrally with the cooling fan so as to shred foreign matters; and a screen cover having a plurality of openings defined therein and attached to the fan housing so as to suppress entry, into the fan housing, of foreign matters drawn by the cooling fan. The screen cover has a polygonal outer shape when viewed from an axial direction of the engine rotation shaft.

18 Claims, 7 Drawing Sheets

AIR-COOLED ENGINE

BACKGROUND OF THE INVENTION

Field of the Invention

The present invention relates to an air-cooled engine that is cooled by cooling air generated by a cooling fan.

Description of Related Art

Air-cooled engines used for e.g. mowers have been known in which a disk-shaped screen rotates integrally with a cooling fan and a screen cover covers the screen. In such engines, foreign matters (e.g., grass clippings) are sucked in together with air when the cooling fan operates. If the foreign matters get into the engine, they may stick to cooling fins of a cylinder, leading to deterioration in cooling performance of the engine. Thus, the screen cover is provided so as to suppress entry of the foreign matters, and the screen is used to finely shred the foreign matters.

However, since it is difficult to completely shred foreign matters to a desired size or smaller, it is required to improve shredding capability.

SUMMARY OF THE INVENTION

An object of the present invention is to provide a cover structure for an air-cooled engine, which is capable of improving the capability to shred foreign matters.

In order to achieve the above object, an air-cooled engine of the present invention includes:

- a cooling fan configured to rotate in conjunction with an engine rotation shaft;
- a fan housing covering the cooling fan;
- a screen having a disk shape and configured to rotate integrally with the cooling fan so as to shred foreign matters; and
- a screen cover having a plurality of openings defined therein and attached to the fan housing, the screen cover suppressing entry, into the fan housing, of foreign matters of a specific size or larger which are drawn by the cooling fan, wherein
- the screen cover has a polygonal outer shape when viewed from an axial direction of the engine rotation shaft.

According to this configuration, a non-constant radial distance (gap) is defined between an outer edge of the screen and an inner surface of the screen cover in a circumferential direction of the screen. Specifically, the outer edge of the screen and the inner surface of the screen cover define a gap therebetween such that large-gap regions where the gap is larger and small-gap regions where the gap is smaller are alternately arranged. Thus, in the small-gap regions where the gap is smaller between the outer edge of the screen and the inner surface of the screen cover, a foreign matter rotates having one end caught in the gap of the screen and the other end hit against the screen cover so that the capability to shred the foreign matters is improved. As a result, it is possible to reduce the amount of the foreign matters sticking to the cooling fins of the cylinders so as to prevent deterioration of the cooling performance of the engine.

In the present invention, the screen cover may be inclined so as to have a decreasing outer diameter with an increasing distance from the cooling fan in the axial direction of the engine rotation shaft on a cross section along a plane including an axis of the engine rotation shaft. According to this configuration, the screen cover is formed in a pyramid shape, and therefore, it is easier to suppress deformation due to a force applied in the axial direction of the engine rotation shaft when compared to the case where the screen cover has a cylindrical shape. The rigidity of the screen cover is thus improved.

In the present invention, a shield part configured to prevent entry of foreign matters into the fan housing may be formed at a central part of the screen cover having the polygonal shape. The screen has a higher shredding capability in an outer edge part thereof thanks to a higher peripheral speed of rotation at this part, whereas the screen has a lower shredding capability at the central part. This configuration makes it possible to prevent introduction of the foreign matters to the central part where the shredding effect is lower. As a result, the capability to shred the foreign matters is improved.

In the present invention, on the cross section along the plane including the axis of the engine rotation shaft, the screen cover may include: a first inclined part inclined so as to have a decreasing outer diameter from a first proximal end portion that is in contact with the fan housing toward a first distal end portion; and a second inclined part inclined at an inclination angle larger than an inclination angle of the first inclined part so as to have a decreasing outer diameter from a second proximal end portion connected to the first distal end portion of the first inclined part toward a second distal end portion. As used herein, the term "inclination angle" refers to an inclination angle with respect to the axial direction of the engine rotation shaft. This configuration makes it possible to enhance the rigidity of the screen cover while providing a sufficient axial distance between the screen and the screen cover. Since the screen and the screen cover are separated in the axial direction, for example, it is possible to prevent the screen cover from coming into contact with the screen due to an external impact.

In the present invention, the screen cover may include: a first rib having a main part, at least the main part extending in a radial direction of an inscribed circle of the polygonal shape when viewed from the axial direction of the engine rotation shaft; and a second rib extending in tangential directions of circles concentric with the inscribed circle when viewed from the axial direction. In such a case, the first rib may be thicker than the second rib. According to this configuration, the two types of the ribs enhance the rigidity of the screen cover. Also, the two types of the ribs having different thicknesses can effectively reinforce the screen cover.

Where the first ribs and the second ribs are provided, the first rib may extend from corners of the screen cover having the polygonal shape. This configuration makes it possible to enhance the rigidity of portions of the screen cover at which stress is concentrated.

In such a case, the screen cover may include a frame part constituting an outer peripheral edge of the polygonal shape, and a plurality of the first ribs, two adjacent ones of the first ribs and the frame part being located on three sides of a triangle when viewed from the axial direction of the engine rotation shaft. For example, two of the first ribs and the frame part define an isosceles triangle having the apex on the axis of engine rotation shaft. This configuration makes it possible to enhance the rigidity of the portions of the screen cover at which stress is concentrated.

Where the first ribs and the second ribs are provided, the screen cover may be removably attached to the fan housing by a fastener; the screen cover may be provided with an attachment part through which the fastener is inserted; and the first rib may extend from the attachment part in the radial direction. According to this configuration, the first ribs improve the rigidity of the attachment part.

In such a case, the attachment part may be provided so as to protrude radially outward from a side of the polygonal shape of the screen cover when viewed from the axial direction of the engine rotation shaft. According to this configuration, the attachment part provided at the side of the polygonal shape makes it possible to reduce the space for disposing the entire screen cover.

Where the first ribs and the second ribs are provided, the screen cover may include a plurality of the second ribs aligned in the radial direction, and a part of the plurality of second ribs may be longer than the rest of the second ribs in the axial direction of the engine rotation shaft. According to this configuration, the part of the second ribs which is longer than the rest of the second ribs in the axial direction of the engine rotation shaft makes it possible to effectively reinforce the portions of the screen cover at which stress is concentrated while keeping sufficient opening areas between the adjacent second ribs in other sections so as to secure a necessary amount of air.

In the present invention, the polygonal shape may be, for example, a hexagon. The screen cover is attached to the fan housing typically at three or more points. A hexagonal structure enables a well-balanced attachment when the cover is fixed at three points.

In the present invention, the screen cover may include a plurality of the first ribs and third ribs each located at an intermediate position between the two adjacent ones of the first ribs. In such a case, each of the third ribs may extend from a side of the polygonal shape in a direction including an axial component of the engine rotation shaft. Also, each of the third ribs may extend in a direction including an axial component of the engine rotation shaft from a position in the vicinity of a point at which the inscribed circle of the screen cover having the polygonal shape is in contact with the polygonal shape of the screen cover. According to this configuration, since the third ribs are provided in the areas where the distance between the outer edge of the screen and the inner surface of the screen cover is smaller, foreign matters are more likely to be caught by the third ribs so as to be shredded.

In the present invention, the screen cover may be removably attached to the fan housing by a fastener; the screen cover may be provided with an attachment part through which the fastener is inserted; and the attachment part may be provided so as to protrude radially outward from a side of the polygonal shape of the screen cover. In such a case, the attachment part may be provided so as to protrude radially outward from a position in the vicinity of a point at which the inscribed circle of the screen cover having the polygonal shape is in contact with the polygonal shape of the screen cover. According to this configuration, the attachment part provided at the side of the polygonal shape makes it possible to reduce the space for disposing the entire screen cover.

In the present invention, the screen cover may have a regular-polygonal outer shape when viewed from the axial direction of the engine rotation shaft. This configuration makes it possible to provide areas where the distance between the outer edge of the screen and the inner surface of the screen cover is small, at equal intervals in the circumferential direction.

The present invention encompasses any combination of at least two features disclosed in the claims and/or the specification and/or the drawings. In particular, any combination of two or more of the appended claims should be equally construed as included within the scope of the present invention.

BRIEF DESCRIPTION OF THE DRAWINGS

The present invention will be more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views:

DESCRIPTION OF THE EMBODIMENTS

Figure 1:
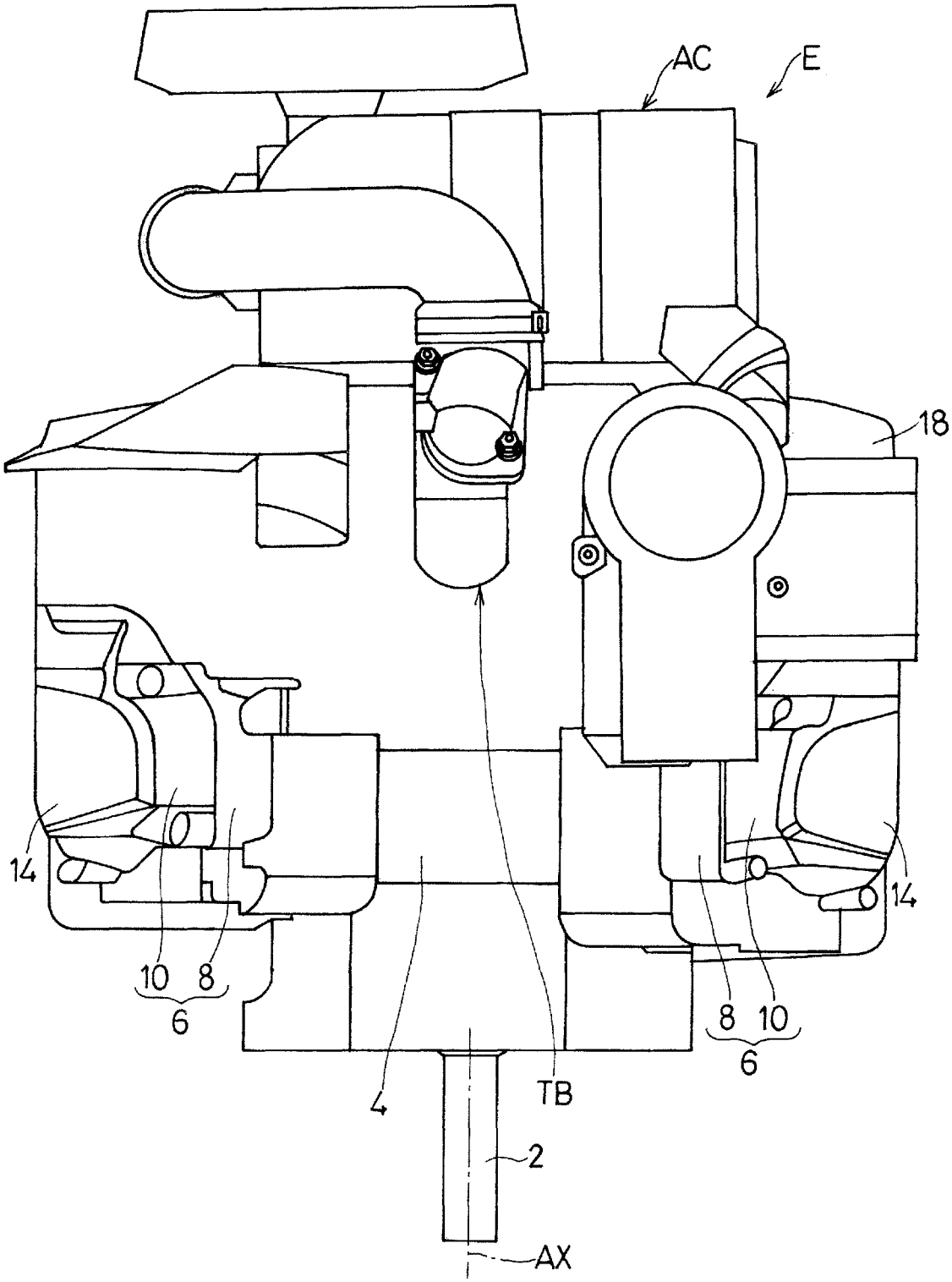
FIG. 1 is a front view of an air-cooled engine according to a first embodiment of the present invention.

Hereinafter, a preferred embodiment of the present invention will be described with reference to the drawings. In FIG. 1, the engine E including a cover structure according to a first embodiment of the present invention is a so-called V-type engine in which cylinder axes A1 of two cylinder units 6 extend in a V shape. The engine E of the present embodiment is an air-cooled vertical-twin engine having a rotation shaft extending in a vertical direction and may be mounted in e.g. a riding mower such that the rotation shaft extends in the vertical direction. In the following description, the term "front" and the like refer to a V-bank side, i.e., a direction in which the V shape is opened in a state where the engine is mounted in a machine (e.g., a mower or an agricultural machine), and the term "rear" and the like refer to the opposite side. Also, the "vertical direction" and the like refer to an axial direction of a rotation shaft of the machine, and the "widthwise direction" and the like refer to a direction perpendicular to both of the vertical direction and the front/rear direction. However, the type and application of the engine E are not limited to these.

The engine E of the present embodiment includes: a crankshaft 2 (one example of the engine rotation shaft) having an axis AX extending in the vertical direction in a state where the engine is mounted in the machine; a crankcase 4 supporting the crankshaft 2; and a pair of cylinder units 6, 6 protruding frontward from a front part of the crankcase 4. The crankshaft 2 has a lower end portion to which a power transmission member for transmitting power to a work tool (such as a mower blade) is attached.

Figure 3:
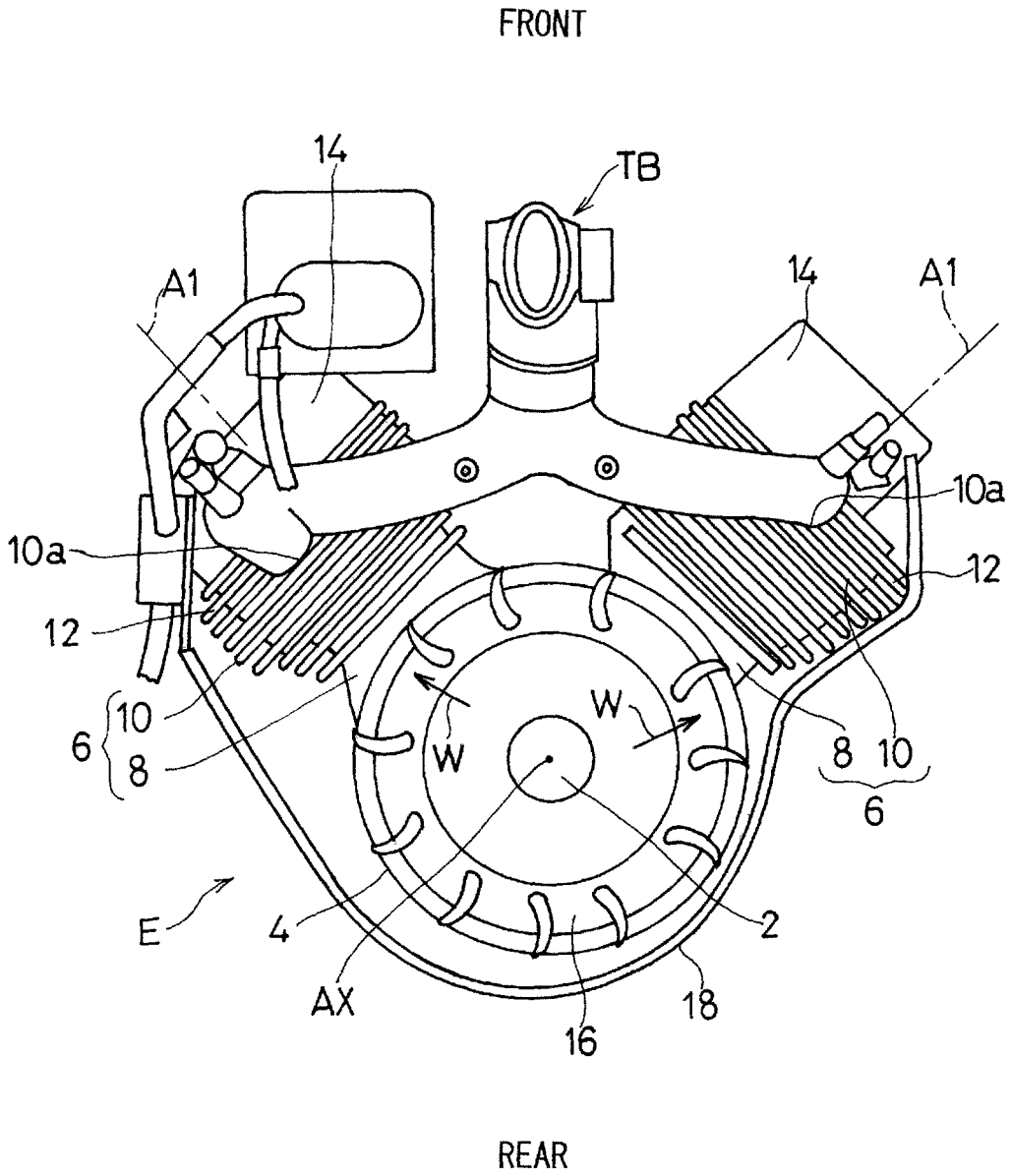
FIG. 3 is a plan view of the engine, with a fan housing removed.

Each cylinder unit 6 includes: a cylinder 8 having a base end portion coupled to the crankcase 4; and a cylinder head 10 coupled to a protruding end portion of the cylinder 8. As shown in FIG. 3, each cylinder unit 6 has a cylinder axis A1 extending frontward and outwardly in a widthwise direction of the engine in a slant manner. The cylinder axes A1 of the two cylinder units 6 define a V shape opened frontward.

A cooling fin 12 is formed on an outer periphery of each cylinder unit 6. The cooling fin 12 provides an increased surface area so that the cooling effect of the air-cooled engine is improved. A head cover 14 is attached to a front end of each cylinder unit 6. An intake port 10*a* is formed on one side (on an upper side in the present embodiment) of each cylinder head 10 in the axial direction AX of the engine rotation shaft 2, and an exhaust port (not illustrated) is formed on the other side (on a lower side in the present embodiment). Intake system components such as an air cleaner AC and a throttle body TB are connected to the intake ports 10*a*, and exhaust system components (not illustrated) such as an exhaust pipe and an exhaust muffler are connected to the exhaust ports.

A cooling fan 16 is attached to an upper end of the crankshaft 2. The cooling fan 16 rotates in conjunction with the engine rotation shaft (crankshaft 2). The cylinder units 6 are cooled by cooling air W generated by the cooling fan 16. The cooling fan 16 is disposed on one side with respect to the cylinder units 6 (above the cylinder units in the present embodiment) in the axial direction AX of the engine rotation shaft 2. The cooling fan 16 of the present embodiment is a sirocco fan configured to feed the cooling air W in a radial fashion from the engine rotation shaft 2 toward a radially outer side. The cooling fan 16 is not limited to this example.

Figure 4:
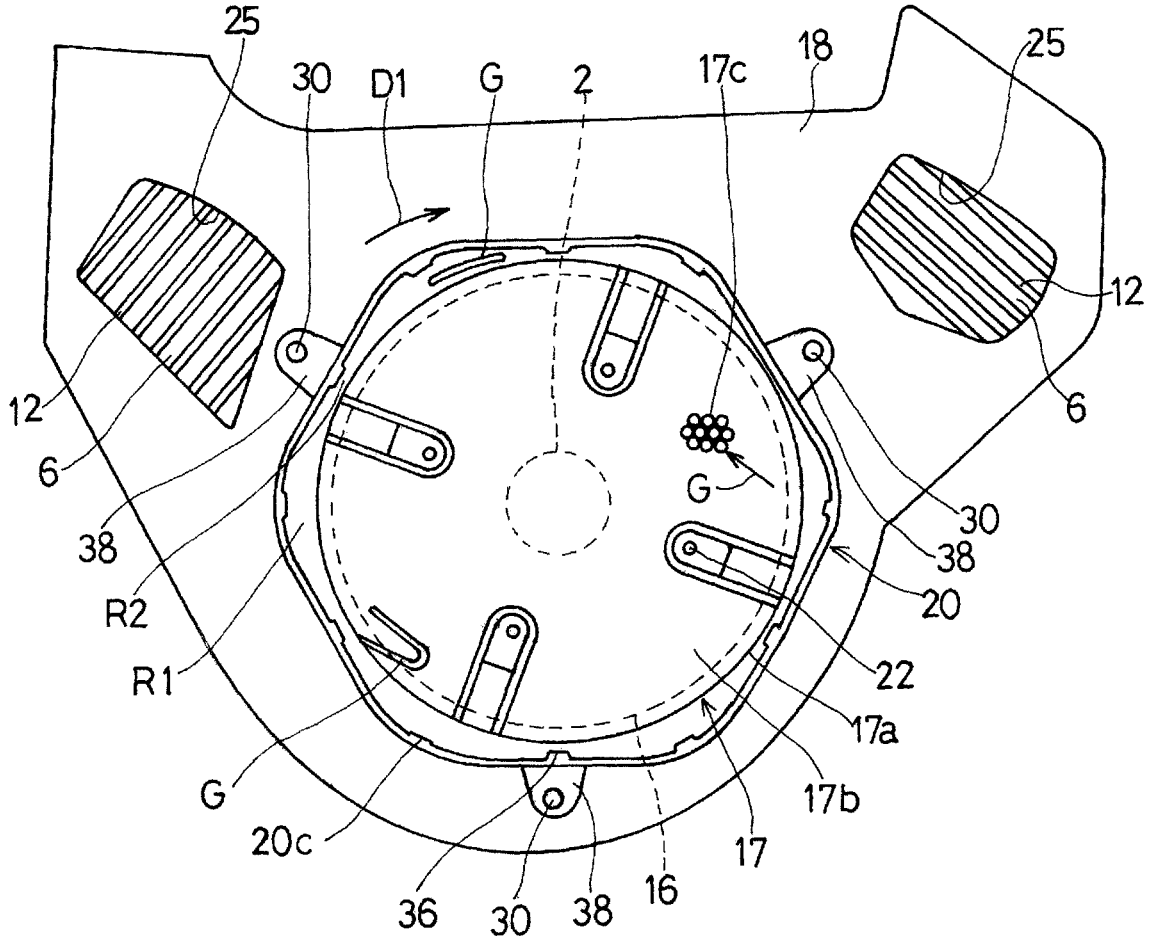
FIG. 4 is a plan view of the engine, with a screen cover partially cut.

A screen 17 having a disk shape as shown in FIG. 4 is attached to an upper end of the cooling fan 16. The screen 17 is configured to rotate integrally with the cooling fan 16 and shred foreign matters G such as grass clippings that are sucked in by a suction force of the cooling fan 16. Details of the screen 17 will be described later.

As shown in FIG. 1, a fan housing 18 is attached to the crankcase 4. The fan housing 18 may be formed of, for example, a sheet metal. The material of the fan housing 18, however, is not limited to this example. The fan housing 18 covers an outer periphery and an upper side of the cooling fan 16 shown in FIG. 3, except for a front side of the cooling fan 16, and guides the cooling air W into the cylinder units 6.

Figure 2:
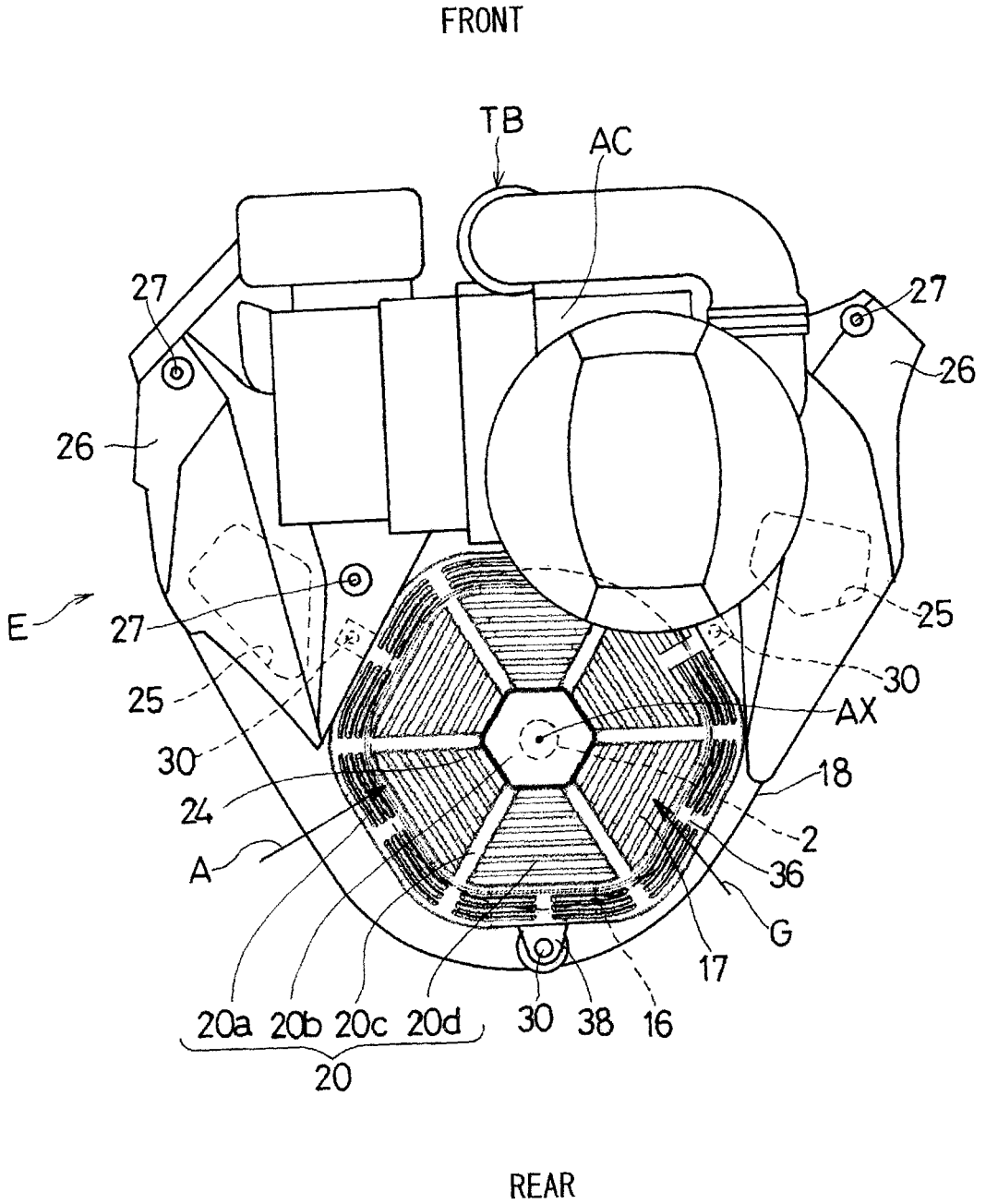
FIG. 2 is a plan view of the engine.

As shown in FIG. 2, the fan housing 18 has an upper side on which opening parts 25 for maintenance of the cylinder units 6 are formed. There are two such opening parts 25 arranged so as to face the cylinder units 6, 6 of the respective cylinders. When carrying out maintenance, for example, an air duster can be inserted from the opening parts 25 to remove grass clippings etc. caught in the cylinder units 6.

Each of the opening parts 25 is closed by a debris cover 26. The debris cover 26 is removably attached to the fan housing 18 by a fastener 27 such as a bolt. The opening part 25 is closed when the debris cover 26 is attached to the fan housing 18, and the opening part 25 is opened when the debris cover 26 is removed from the fan housing 18.

As shown in FIG. 4, the screen 17 includes a cutter part 17*a* that constitutes an outer peripheral edge of the screen 17 and a screen part 17*b* that covers the cooling fan 16 from one side (from above in the present embodiment) in the axial direction AX of the engine rotation shaft 2. The screen 17 is attached to the cooling fan 16 by a plurality of (four in the present embodiment) fasteners 22.

Figure 5:
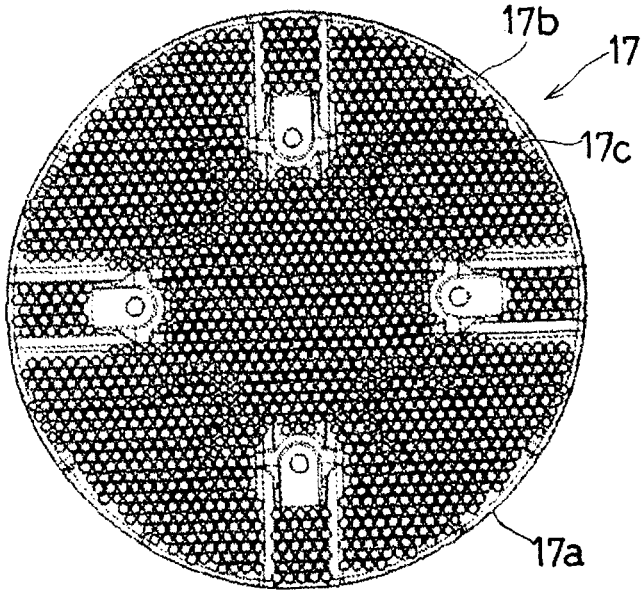
FIG. 5 is a plan view of a screen of the engine.
Figure 6:
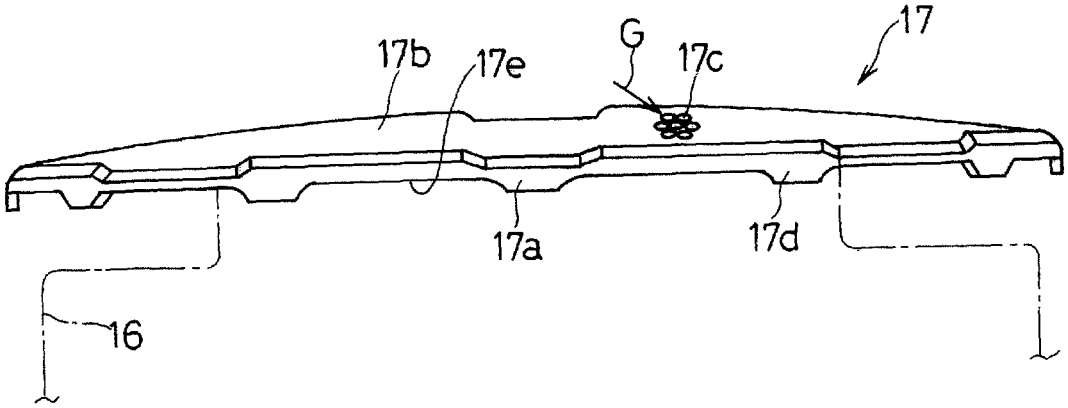
FIG. 6 is a front view of the screen.

The screen 17 is made of, for example, a metal plate material. As shown in FIG. 6, the screen part 17*b* of the screen 17 is smoothly bulged from the cutter part 17*a* at the outer edge to a central part in a direction away from the cooling fan 16 (upwardly in the present embodiment). The screen part 17*b* is formed with a plurality of punch holes 17*c* (FIG. 5) over a substantially entire surface thereof. That is, the air sucked in by the cooling fan 16 can pass through the screen part 17*b*, whereas foreign matters G such as grass clippings do not pass through the screen part 17*b*. The foreign matters G captured by the screen part 17*b* are guided along the smooth surface of the screen part 17*b* to the cutter part 17*a*.

The cutter part 17*a* of the screen 17 includes a plurality of protrusions 17*d* arranged in a circumferential direction as shown in FIG. 6. That is, the cutter part 17*a* has the protrusions 17*d* and recesses 17*e* that are alternately arranged in the circumferential direction. The cutter part 17*a* is configured to shred the foreign matters G passing through the recesses 17*e* by the protrusions 17*d*. More specifically, the protrusions 17*d* and recesses 17*e* and an end portion of the fan housing 18 define a gap therebetween, and the foreign matters G are shredded between the moving protrusions 17*d* and the end portion of the fan housing 18 as they pass through such a gap.

A screen cover 20 is attached to the upper side of the fan housing 18 as shown in FIG. 2. The screen cover 20 covers the screen 17 from above and is fixed to the fan housing 18. The screen cover 20 can suppress entry, into the fan housing 18, of foreign matters G drawn by the cooling fan 16 (FIG. 3), where the foreign matters are of a specific size or larger.

The screen cover 20 shown in FIG. 2 is made of a resin and integrally formed by die molding. The screen cover 20 of the present embodiment has a non-texture processed, smooth surface. The material and the production method for the screen cover 20 are not limited to these.

In the present embodiment, the screen cover 20 has a hexagonal outer shape when viewed from the axial direction AX of the engine rotation shaft 2. However, as long as the screen cover 20 has a polygonal outer shape when viewed from the axial direction AX of the engine rotation shaft 2, the shape is not limited to a hexagonal shape. The screen cover 20 preferably has a regular-polygonal outer shape and more preferably a polygonal outer shape with four or more sides when viewed from the axial direction AX of the engine rotation shaft 2.

The screen cover 20 includes: a frame part 20*a* constituting an outer peripheral edge of the screen cover 20; a central shield part 20*b* having a plate shape; first ribs 20*c* connecting the frame part 20*a* and the shield part 20*b*; and second ribs 20*d* intersecting with the first ribs 20*c*. The first ribs 20*c* and the second ribs 20*d* define a plurality of slit-like openings 24. Air A can passes through the openings 24 and flows into the fan housing 18, whereas foreign matters G larger than the openings 24 cannot pass through the screen cover 20. The plate-like shield part 20*b* is constituted by a face perpendicular to the axial direction AX of the engine rotation shaft 2. The frame part 20*a* constitutes an outer peripheral edge of the polygonal (hexagonal) screen cover 20.

Figure 8:
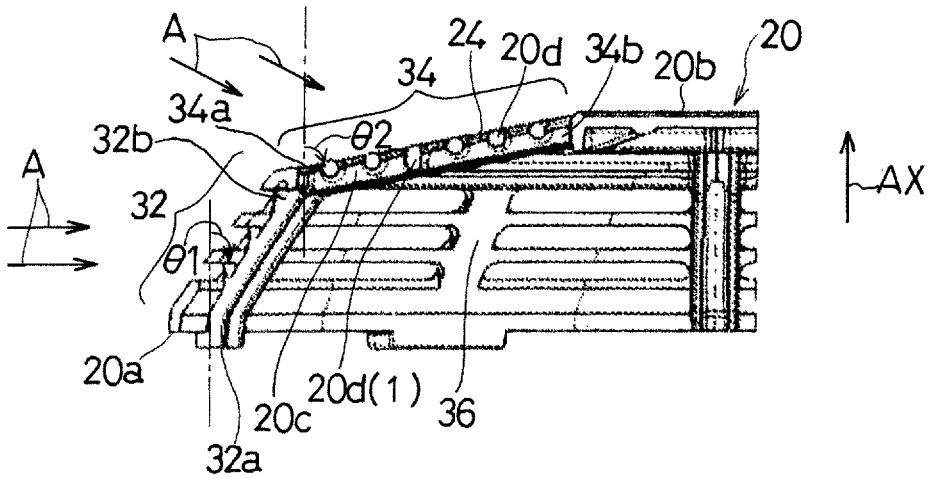
FIG. 8 is a longitudinal cross-sectional view of a part of the screen cover.

The screen cover 20 is bulged from the frame part 20*a* at the outer edge to the shield part 20*b* at the center in a direction away from the screen 17 (upwardly in the present embodiment). Specifically, as shown in FIG. 8, the screen cover 20 is inclined so as to have a decreasing outer diameter (toward the top of FIG. 8) with an increasing distance from the screen 17 (cooling fan 16) in the axial direction AX of the engine rotation shaft 2 on a cross section along a plane including the axis of the engine rotation shaft 2.

More specifically, the screen cover 20 includes a first inclined part 32 and a second inclined part 34 having a different inclination angle from that of the first inclined part. As used herein, the term "inclination angle" refers to an inclination angle with respect to the axial direction AX of the engine rotation shaft 2. On the cross-section along a plane including the axis AX of the engine rotation shaft 2, the first inclined part 32 of the screen cover 20 is inclined so as to have a decreasing outer diameter from a first proximal end portion 32*a* that is in contact with the fan housing 18 toward a first distal end portion 32*b*.

The second inclined part 34 of the screen cover 20 is inclined at an inclination angle θ2 larger than an inclination angle θ1 of the first inclined part 32 so as to have a decreasing outer diameter from a second proximal end portion 34*a* connected to the first distal end portion 32*b* of the first inclined part 32 toward a second distal end portion 34*b*. The second distal end portion 34*b* of the second inclined part 34 is connected to the shield part 20*b* at the center of the screen cover 20.

Figure 7:
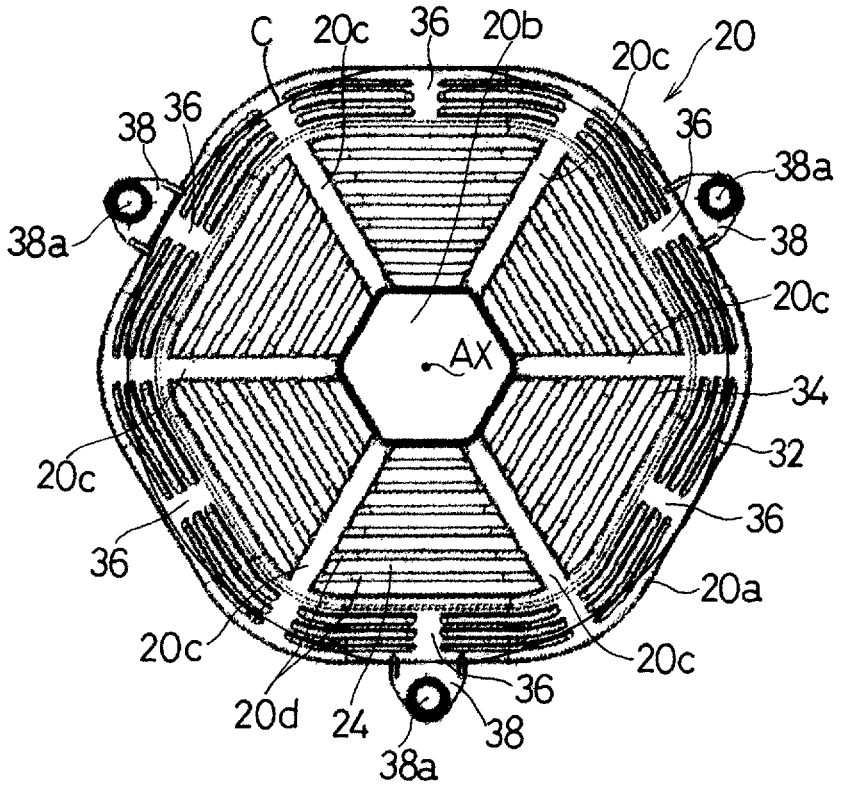
FIG. 7 is a plan view of the screen cover of the engine.

As shown in FIG. 7, the first ribs 20*c* extend in a radial direction of an inscribed circle C of the polygon (hexagon). It is only necessary that at least main parts of the first ribs 20*c* extend in the radial direction when viewed from the axial direction. AX of the engine rotation shaft 2. In the present embodiment, the first ribs 20*c* extend from corners of the polygonal (hexagonal) screen cover 20. In other words, two adjacent ones of the first ribs 20*c* and the frame part 20*b* are located on three sides of a triangle when viewed from the axial direction AX of the engine rotation shaft 2. In the present embodiment, two of the first ribs 20*c*, 20*c* and the frame part 20*b* define an isosceles triangle having the apex on the axis AX of engine rotation shaft 2.

On the other hand, the second ribs 20*d* extend parallel to tangential directions of circles concentric with the inscribed circle C of the polygonal screen cover 20. It is only necessary that the second ribs 20*d* extend in the tangential directions of the concentric circles when viewed from the axial direction AX of the engine rotation shaft 2. There are a plurality of such second ribs 20*d* aligned on a radially outer side with respect to the axial direction AX. In the present embodiment, as shown in FIG. 8, a part (denoted by 20*d*(1) in FIG. 8) of the plurality of second ribs 20*d* is longer than the rest of the second ribs in the axial direction AX of the engine rotation shaft 2. That is, a part 20*d*(1) of the second ribs 20*d* is thicker and, therefore, has a larger cross section than the rest of the second ribs 20*d* in the axial direction AX. However, all the second ribs 20*d* may have a same thickness.

As shown in FIG. 7, in the present embodiment, the first ribs 20*c* are thicker than the second ribs 20*d*, i.e., wider in the circumferential direction. However, the first ribs 20*c* and the second ribs 20*d* may have a same thickness, or the second ribs 20*d* may be thicker than the first ribs 20*c*.

The screen cover 20 further includes third ribs 36 each located at an intermediate position between two adjacent ones of the first ribs 20*c*, 20*c*. Each of the third ribs 36 extends from a side of the polygonal shape of the screen cover 20 in a direction including a component of the axial direction AX of the engine rotation shaft 2. The third ribs 36 are formed in the first inclined part 32 and extend from the sides of the frame part 20*a* of the polygonal screen cover 20 along the first inclined part 32. Specifically, each of the third ribs 36 is formed at a position in the vicinity of a point at which the inscribed circle C of the screen cover 20 is closest to (as used herein, expressed as "in contact with") the polygonal screen cover 20. The third ribs 36 may be omitted.

The screen cover 20 is removably attached to the fan housing 18 by fasteners 30 such as bolts. Specifically, the screen cover 20 is provided with an attachment part 38 having an insertion hole 38*a* through which the fastener 30 is inserted. The screen cover 20 is attached to the fan housing 18 through the attachment part 38. In the present embodiment, the screen cover 20 is attached to the fan housing 18 through three attachment parts 38 disposed approximately 120° apart in the circumferential direction. The number of the attachment parts 38 is not limited to this example.

The attachment part 38 is provided so as to protrude radially outward from a side of the polygonal screen cover 20 when viewed from the axial direction AX of the engine rotation shaft 2. In other words, the attachment part 38 is provided so as to protrude radially outward at a position in the vicinity of a point at which the inscribed circle C of the polygonal screen cover 20 is in contact with the polygonal screen cover 20. In the present embodiment, the third ribs 36 extend from the attachment parts 38 in the axial direction.

The fastener 30 is, for example, a stepped bolt and is screwed into a threaded hole (not illustrated) provided to the fan housing 18. The threaded hole (not illustrated) is, for example, a weld nut. The fastening structure of the screen cover 20 is not limited to this example.

The flow of the cooling air W and foreign matters G in the present embodiment will be described. When the engine E shown in FIG. 2 is started and causes the crankshaft 2 to rotate, the cooling fan 16 and the rotary screen 17 also rotate integrally with the crankshaft 2. As the cooling fan 16 rotates, the air A is sucked into the fan housing 18 as the cooling air W. The cooling air W is guided in the fan housing 18 and flows downward so as to cool cooling target components such as the cylinder units 6, 6.

During operation, foreign matters G such as grass clippings cut by a mower blade are blown up and move toward the upper side of the engine E. Such foreign matters G are sucked into the fan housing 18 due to a suction force of the cooling fan 16. The foreign matters G of a specific size or larger (e.g., grass clippings longer than 10 cm) are blocked by the screen cover 20 and thus cannot enter the fan housing 18. Although the foreign matters G such as grass cuttings smaller than the openings 24 of the screen cover 20 (e.g., grass clippings of about 5 to 6 cm long) may pass through the screen cover 20, they will be shredded finely (e.g., into grass clippings shorter than 1 cm) by the screen 17 shown in FIG. 4. The foreign matters G shredded by the screen 17 is exhausted from the gap between the crankcase 4 and the fan housing 18 shown in FIG. 1.

Figure 9A:
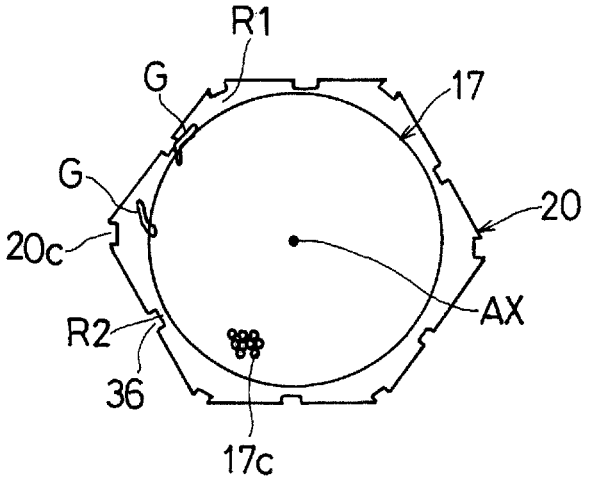
FIG. 9A is a schematic view of the screen and the screen cover.
Figure 9B:
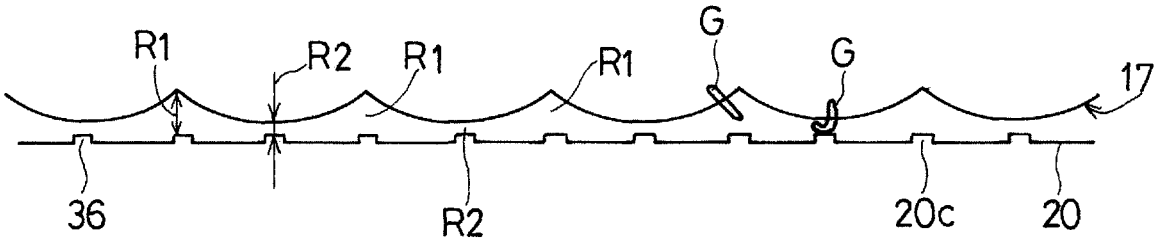
FIG. 9B is a developed view of the screen cover shown in FIG. 9A, in which the sides of the screen cover are developed in a linear manner.

Since, as shown in FIG. 4, the screen 17 has a disk shape and the screen cover 20 has a hexagonal shape, a radial distance (gap) between the cutter part 17*a* at the outer edge of the screen 17 and an inner surface of the screen cover 20 is not constant in the circumferential direction of the screen 17 that rotates in a rotation direction D1. Specifically, as shown in FIGS. 9A and 9B, the cutter part 17*a* of the screen 17 and the inner surface of the screen cover 20 define a gap therebetween such that large-gap regions R1 where the gap is larger and small-gap regions R2 where the gap is smaller are alternately arranged. Thus, in the small-gap region R2 where the gap is smaller between the outer edge of the screen and the inner surface of the screen cover, the foreign matter G rotates having one end caught in the gap of the screen and the other end hit against the screen cover 20 so that the capability to shred the foreign matters G is improved.

Also, elongated foreign matters G such as grass clippings may be caught (clogged) in the punch holes 17*c* of the screen part 17*b* of the screen 17. Clogging of such foreign matters G is, in particular, likely to occur at the outer peripheral part of the screen part 17*b* in which a strong suction force is generated. In the present invention, thanks to the alternate arrangement of the large-gap regions R1 where the gap between the cutter part 17*a* of the screen 17 and the inner surface of the screen cover 20 is larger and the small-gap regions R2 where the gap is smaller, when the screen 17 rotates, one end of the foreign matter G is caught in the screen part 17*b* and the other end thereof is brought into contact with the screen cover 20 multiple times in the small-gap regions R2 in such a manner that the other end thereof is hit against the screen cover 17. Consequently, the foreign matters G caught in the screen part 17*b* are removed from the punch holes 17*c* and flow to the cutter part 17*a* so as to be shredded.

According to the above configuration, the cutter part 17*a* of the screen 17 and the inner surface of the screen cover 20 define the gap therebetween such that the large-gap regions R1 where the gap is larger and the small-gap regions R2 where the gap is smaller are alternately arranged as discussed above. Thus, in the small-gap regions R2, the foreign matter G rotates having one end caught in the gap of the screen, and the other end thereof is hit against the screen cover 20 so that the capability to shred the foreign matters G is improved. As a result, it is possible to reduce the amount of the foreign matters G sticking to the cooling fins 12 of the cylinders 6 so as to prevent deterioration of the cooling performance of the engine E.

As shown in FIG. 8, the screen cover 20 is inclined so as to have a decreasing outer diameter with an increasing distance from the cooling fan 16 in the axial direction AX of the engine rotation shaft 2. Thus, the screen cover 20 is formed in a pyramid shape, and therefore, it is easier to suppress deformation due to a force applied in the axial direction when compared to a cylindrical shape. The rigidity of the screen cover 20 is thus improved.

The screen cover 20 includes two inclined parts 32, 34 which have different inclination angles θ1, θ2 from each other. This makes it possible to enhance the rigidity of the screen cover 20 while providing a sufficient distance between the screen 17 and the screen cover 20 in the axial direction AX. Where the screen 17 and the screen cover 20 are separated in the axial direction, for example, it is possible to prevent the screen cover 20 from coming into contact with the screen 17 due to an external impact.

As shown in FIG. 7, the flat shield part 20*b* is formed at a central part of the screen cover 20. Although not playing a predominant role, the punch holes 17*c* of the screen part 17*b* also serve to shred the foreign matters due to the rotation of the screen part 17*b*. When the screen part 17*b* rotates at a certain angular speed, the central part and the outer edge part make one revolution at a same angular speed. Since the punch holes 17*c* located in a radially outer portion of the screen part 17*b* move over a greater distance per unit time, the punch holes 17*c* in the radially outer portion move at a higher movement speed. Therefore, the punch holes 17*c* in the radially outer portion of the screen 17 provide a stronger shedding effect. In contrast, the holes in the central part provide a weaker shedding effect so that the foreign matters are more likely to cause clogging. Provision of the shield part 20*b* at the central part of the screen cover 20 as in the above feature can prevent introduction of the foreign matters G to the central part where the shredding effect is lower. As a result, the capability to shred the foreign matters G is improved.

The screen cover 20 includes the first ribs 20*c* and the second ribs 20*d*, and the first ribs 20*c* are thicker than the second ribs 20*d*. Therefore, the two types of the ribs 20*c*, 20*d* enhance the rigidity of the screen cover 20, and the two types of the ribs 20*c*, 20*d* having different thicknesses can effectively reinforce the screen cover 20.

The first ribs 20*c* extend from corners of the hexagonal screen cover 20, and therefore, the portions of the screen cover 20 at which stress is concentrated can have the enhanced rigidity.

Two adjacent ones of the first ribs 20*c* and the frame part 20*a* are located on three sides of a triangle. Specifically, the two adjacent ones of the first ribs 20*c* and the frame part 20*a* define an isosceles triangle having the apex on the axis AX of engine rotation shaft 2. This makes it possible to enhance the rigidity of the portions of the screen cover 20 at which stress is concentrated.

The screen cover 20 is provided with the third ribs 36, and the third ribs 36 of the screen cover 20 extend from the attachment parts 38 in the axial direction. Thus, the third ribs 36 enhance the rigidity of the attachment parts 38. Consequently, the screen cover 20 can be supported stably. The third ribs 36 are provided at positions in the vicinity of points at which the inscribed circle C of the screen cover 20 is in contact with the screen cover 20. Thus, the third ribs 36 shown in FIG. 7 are provided in the regions R2 where the distance between the outer edge of the screen 17 and the inner surface of the screen cover 20 is smaller as shown in FIG. 4, so that foreign matters G are more likely to be caught by the third ribs 36 so as to be shredded.

The attachment parts 38 are provided so as to protrude radially outward from sides of the hexagonal screen cover 20. Thus, since the attachment parts 38 is provided to the sides of the hexagon, it is possible to reduce a space for disposing the entire screen cover 20. The screen cover 20 is attached to the fan housing 18 typically at three or more points. According to the above configuration, since the screen cover 20 has a hexagonal shape, the attachment parts 38 are arranged at equal intervals in the circumferential direction when the screen cover 20 is fixed at three points so that a well-balanced attachment is achieved. In addition, since the screen cover 20 is shaped in a regular hexagon, the regions R2 (FIG. 4) where the distance between the outer edge of the screen 17 and the inner surface of the screen cover 20 is small can also be arranged at equal intervals in the circumferential direction.

The attachment parts 38 are provided so as to protrude radially outward from the sides of the hexagonal screen cover 20. Specifically, the attachment parts 38 are provided so as to protrude radially outward from the positions in the vicinity of the points at which the inscribed circle C of the screen cover 20 is in contact with the screen cover 20. Thus, the attachment parts 38 provided to the sides of the hexagon make it possible to reduce a space for disposing the entire screen cover 20.

There are a plurality of the second ribs 20*d* aligned in the radial direction, and a part of the plurality of second ribs 20*d* is longer than the rest of the second ribs 20*d* in the axial direction AX of the engine rotation shaft 2 as shown in FIG. 8. During operation, the air A is sucked into the first inclined part 32 from the horizontal direction, and the air A is sucked into the second inclined part 34 from diagonally above. On this account, if all the second ribs 20*d* of the second inclined part 34 are elongated in the axial direction AX (vertical direction), the areas of the openings 24 between the adjacent second ribs 20*d* would be reduced so that a smaller amount of air is introduced. In contrast, if all the second ribs 20*d* are thin, they would have a reduced reinforcing effect for the screen cover 20. According to the above configuration, one second rib 20*d*(1) of the second ribs 20*d* aligned in the radial direction, which is located in an intermediate part in the radial direction, is thicker than the rest of the second ribs, and therefore, the screen cover 20 can be effectively reinforced while keeping sufficient areas of the openings 24 defined between the second ribs 20*d* so that a necessary amount of air is secured.

In the above embodiment, the first ribs 20*c* shown in FIG. 7 are formed at the corners of the polygonal screen cover 20, and the third ribs 36 are formed at positions on the sides of the polygonal screen cover 20. Alternatively, the first ribs 20*c* may be formed at positions on the sides of the screen cover 20, and the third ribs 36 may be formed at the corners. This configuration also provides the same effects as those of the above embodiment. In addition, although the second ribs 20*d* are formed so as to linearly extend between the adjacent first ribs 20*c* in the above embodiment, they may be structured in such a way that the second ribs 20*d* are branched in the radial direction so as to define honeycomb-like openings 24 between the second ribs 20*d*. In such a case, for example, a load applied from above the screen 17 is distributed on the upper side of the screen 17 due to the honeycomb-like bridge structure defining the opening 24, so that the strength of the screen cover 20 is improved.

The present invention is not intended to be limited to the above embodiment, and various addition, changes, or deletions may be made without departing from the scope of the invention. For example, although the above embodiment has been described with reference to a V-twin engine, the cover structure of the present invention may be applied to engines other than V-twin engines. Accordingly, such variants should also be included within the scope of the present invention.

REFERENCE NUMERALS

2 . . . Crankshaft (engine rotation shaft)
16 . . . Cooling fan
17 . . . Screen
18 . . . Fan housing
20 . . . Screen cover
20*a* . . . Frame part
20*b* . . . Shield part
20*c* . . . First rib
20*d* . . . Second rib
24 . . . Opening
30 . . . Fastener
32 . . . First inclined part
32*a* . . . First proximal end portion
32*b* . . . First distal end portion
34 . . . Second inclined part
34*a* . . . Second proximal end portion
34*b* . . . Second distal end portion
36 . . . Third rib
38 . . . Attachment part
AX . . . Axial direction of the engine rotation shaft
E . . . Air-cooled engine
G . . . Foreign object

What is claimed is:

1. An air-cooled engine comprising:

a cooling fan configured to rotate in conjunction with an engine rotation shaft;

a fan housing covering the cooling fan;

a screen having a disk shape and configured to rotate integrally with the cooling fan so as to shred foreign matters; and a screen cover having a plurality of openings defined therein and attached to the fan housing, the screen cover suppressing entry, into the fan housing, of foreign matters of a specific size or larger which are drawn by the cooling fan, wherein the screen cover has a polygonal outer shape when viewed from an axial direction of the engine rotation shaft.

2. The air-cooled engine as claimed in claim 1, wherein the screen cover is inclined so as to have a decreasing outer diameter with an increasing distance from the cooling fan in the axial direction of the engine rotation shaft on a cross section along a plane including an axis of the engine rotation shaft.

3. The air-cooled engine as claimed in claim 1, further comprising a shield part configured to prevent entry of foreign matters into the fan housing, the shield part being formed at a central part of the screen cover having the polygonal shape.

4. The air-cooled engine as claimed in claim 1, wherein on the cross section along a plane including an axis of the engine rotation shaft, the screen cover includes: a first inclined part inclined so as to have a decreasing outer diameter from a first proximal end portion that is in contact with the fan housing toward a first distal end portion; and a second inclined part inclined at an inclination angle larger than an inclination angle of the first inclined part so as to have a decreasing outer diameter from a second proximal end portion connected to the first distal end portion of the first inclined part toward a second distal end portion.

5. The air-cooled engine as claimed in claim 1, wherein the screen cover includes: a first rib having a main part, at least the main part extending in a radial direction of an inscribed circle of the polygonal shape when viewed from the axial direction of the engine rotation shaft; and a second rib extending in tangential directions of circles concentric with the inscribed circle when viewed from the axial direction.

6. The air-cooled engine as claimed in claim 5, wherein the first rib is thicker than the second rib.

7. The air-cooled engine as claimed in claim 5, wherein the first rib extends from a corner of the screen cover having the polygonal shape.

8. The air-cooled engine as claimed in claim 7, wherein the screen cover includes a frame part constituting an outer peripheral edge of the polygonal shape, and a plurality of the first ribs, two adjacent ones of the first ribs and the frame part being located on three sides of a triangle when viewed from the axial direction of the engine rotation shaft.

9. The air-cooled engine as claimed in claim 5, wherein the screen cover is removably attached to the fan housing by a fastener, the screen cover is provided with an attachment part through which the fastener is inserted, and the first rib extends from the attachment part in the radial direction.

10. The air-cooled engine as claimed in claim 9, wherein the attachment part is provided so as to protrude radially outward from a side of the polygonal shape of the screen cover when viewed from the axial direction of the engine rotation shaft.

11. The air-cooled engine as claimed in claim 5, wherein the screen cover includes a plurality of the second ribs aligned in the radial direction, and a part of the plurality of second ribs is longer than the rest of the second ribs in the axial direction of the engine rotation shaft.

12. The air-cooled engine as claimed in claim 1, wherein the polygonal shape is a hexagon.

13. The air-cooled engine as claimed in claim 1, wherein the screen cover includes a plurality of the first ribs and third rib located at an intermediate position between two adjacent ones of the first ribs.

14. The air-cooled engine as claimed in claim 13, wherein each of the third ribs extends from a side of the polygonal shape in a direction including an axial component of the engine rotation shaft.

15. The air-cooled engine as claimed in claim 13, wherein each of the third ribs extends from a position in the vicinity of a point at which an inscribed circle of the screen cover having the polygonal shape is in contact with the polygonal shape of the screen cover in a direction including an axial component of the engine rotation shaft.

16. The air-cooled engine as claimed in claim 1, wherein the screen cover is removably attached to the fan housing by a fastener, the screen cover is provided with an attachment part through which the fastener is inserted, and the attachment part is provided so as to protrude radially outward from a side of the polygonal shape of the screen cover.

17. The air-cooled engine as claimed in claim 16, wherein the attachment part is provided so as to protrude radially outward from a position in the vicinity of a point at which an inscribed circle of the screen cover having the polygonal shape is in contact with the polygonal shape of the screen cover.

18. The air-cooled engine as claimed in claim 1, wherein the screen cover has a regular-polygonal outer shape when viewed from the axial direction of the engine rotation shaft.

* * * * *